US005955996A

United States Patent [19]

Clubb

[11] Patent Number: 5,955,996

[45] Date of Patent: Sep. 21, 1999

[54] TUNABLE FIBERGLASS ANTENNA

[75] Inventor: Norris M. Clubb, Asheville, N.C.

[73] Assignee: Tandy Corporation, Fort Worth, Tex.

[21] Appl. No.: 08/802,086

[22] Filed: Feb. 18, 1997

Related U.S. Application Data

[63] Continuation of application No. 08/517,942, Aug. 22, 1995, abandoned.

[51] Int. Cl.[6] ..... H01Q 9/00; H01Q 1/32

[52] U.S. Cl. ..... 343/749; 343/745; 343/715; 343/895; 343/900

[58] Field of Search ..... 343/745, 749, 343/750, 752, 715, 872, 895, 900, 906

[56] References Cited

U.S. PATENT DOCUMENTS

| | | | |
|---|---|---|---|
| 2,875,443 | 2/1959 | Kandoian | 343/749 |
| 4,080,604 | 3/1978 | Wosniewski | 343/745 |
| 4,104,639 | 8/1978 | Muchiarone | 343/752 |
| 4,152,705 | 5/1979 | Kowds | 343/750 |
| 4,379,298 | 4/1983 | Vincent et al. | 343/750 |
| 4,460,896 | 7/1984 | Shmitka | 343/750 |
| 4,620,194 | 10/1986 | Bel Moratalla | 343/750 |
| 4,958,164 | 9/1990 | Lewis, Jr. | 343/749 |
| 5,274,393 | 12/1993 | Scott | 343/895 |

*Primary Examiner*—Don Wong
*Assistant Examiner*—Tan Ho
*Attorney, Agent, or Firm*—John F. McGowan; William A. Linnell

[57] ABSTRACT

A tunable capacitive coupling to a monopole antenna is provided which integrates the tuning mechanism into the supporting structure for the antenna. The base of the antenna is insulated from and supported by a cylindrical clamping assembly such as a metal compression ferrule in cooperation with an adjustment collar. This clamping mechanism enables the ferrule to be tightened like a drill bit in a chuck at any position along the base of the antenna. The coupling capacitance formed between the antenna radiator and the compression ferrule is proportional to the insertion depth of the antenna into the compression ferrule, thereby enabling the antenna to be tuned. The coupling method of the present invention enables repeatable tuning of the antenna either upward or downward in frequency within the band of frequencies accommodated by the particular antenna. The invention works especially well with so-called fiberglass antennas but is adaptable to metal elements having a lumped inductance and suitable insulation around the end of the antenna supported in the clamping assembly.

19 Claims, 4 Drawing Sheets

*TUNED FOR OPTIMUM PERFOMANCE OVER ENTIRE CITIZENBAND*

*LOWER AND UPPER TUNING RANGE*

TUNABLE FIBERGLASS ANTENNA

This is a continuation of application 08/517,942 filed Aug. 22, 1995, now abandoned.

The present invention is related generally to monopole communications antennas and more particularly to a method and apparatus for integrating a tunable capacitance coupling mechanism into the mounting support for a fiberglass antenna.

BACKGROUND OF THE INVENTION

Conventional fiberglass communications antennas intended primarily for mobile use such as in the Citizen's Band radio service are either fixed-tuned by the manufacturer or supplied with one of a variety of mechanisms for tuning. These tuning mechanisms typically vary the length of the antenna or vary the value of an inductance incorporated into the structure of the antenna. Another means employs a tunable network in the signal line adjacent the base of the antenna.

A so-called fiberglass antenna consists of a wire helically wound around a flexible fiberglass rod to provide an electrically long, physically short, and durable antenna. Such a construction is especially suited to low cost mobile antennas which are subject to extreme conditions of use. However, the typical fiberglass rod antenna cannot easily be tuned by the user by adjusting the length of the antenna or varying its inductance value because of its pecuiar construction. The only practical way a fiberglass antenna heretofore could be tuned was to cut it to a shorter length corresponding to the desired frequency as discussed for example in a procedure described on page 326 of the 1978 edition of the ARRL Radio Amateur Handbook published by the American Radio Relay League, Inc., Newington, Conn. This method necessitates supplying the antenna tuned to the lowest frequency, i.e., the longest wavelength, giving the user the single option to cut it to a shorter wavelength. Unfortunately, this provided for adjustment in only one direction. Moreover, if the user made a mistake and cut the antenna too short, a poorly tuned antenna was the result. Furthermore, the use of a tunable network coupled to an antenna is a relatively expensive means of providing the tuning capability to optimize reception or transmission. A tunable network is at a particular disadvantage at longer wavelengths where the components tend to be physically large and unsuited to low-cost techniques for manufacturing VHF and UHF networks such as strip line circuitry and the like.

SUMMARY OF THE INVENTION

The foregoing problems are solved and a technical advance is achieved by a method and apparatus presented herein for capacitively tuning the signal coupling to a fiberglass or nylon rod antenna element.

In general terms a rod antenna element is retained or clamped at one end in a hollow clamping structure whose internal diameter is slightly larger than the diameter of the rod antenna element. The hollow clamping structure resembles an elongated cylinder made of metal which is used (a) to support the antenna rod in a vertical or horizontal orientation and (b) to provide for a variable capacitance used to tune the antenna to a desired frequency. Capacitance is an electrical quantity which affects the frequency of the currents in a circuit containing one or more capacitors in cooperation with other electrical components such as inductors, resistors, or other components. A capacitor is formed of two parallel conducting surfaces or plates separated by an insulator, i.e., a dielectric material. In the present invention one plate of the capacitor is represented by the conductive surface of the antenna radiating element and the other plate is represented by the internal surface of the metal body of the hollow clamping structure nearest the antenna radiating element. The space separating the "plates" is occupied by the dielectric material to increase the capacitance effect. As the end of the antenna radiating element is moved linearly, i.e., longitudinally, within the hollow clamping structure the amount of capacitance between them is varied in proportion to the amount the end of the antenna is overlapped by the hollow clamping structure thus varying the effective area of the conducting plates separated by dielectric material. It is this relationship between the antenna rod and the hollow clamping structure which is exploited to provide the tunable monopole antenna of the present invention.

It is also important to realize that the variable capacitance formed as described above cooperates with the inductance property of the antenna element to achieve resonance at the desired frequency of reception or transmission of the antenna. Such an antenna having inductance is said to be inductively loaded. The inductance may be a characteristic distributed along the length of the antenna rod or lumped at one or more locations along the antenna, usually near its center or near one of its ends. Monopole antennas having this inductance distributed along the full length of the antenna are often characterized as "continuously loaded" or "fully loaded" even if the distribution is not uniform but varies in some predetermined way. The term loaded refers to the use of series inductance to shorten the physical length of an antenna, usually for antennas operating at longer wave lengths.

In the preferred embodiment, the tuning mechanism is embodied in the supporting structure for the antenna. A dielectric sleeve is interposed between the antenna radiating conductor at the lower end of the rod and the internal bore of the metal compression ferrule which secures the antenna rod to the mounting structure that supports the antenna. A capacitance is thus formed between the antenna radiating conductor and the compression ferrule. This capacitance is variable over a sufficient range to permit tuning the antenna to a resonant condition over a corresponding band of frequencies. Tuning is accomplished by simply varying the insertion depth of the antenna rod within the compression ferrule. The upper end of the compression ferrule is threaded and formed as a collet which, in cooperation with a suitable threaded collar, permits tightening the ferrule to secure the antenna rod at the desired tuning point. The RF signal is supplied to the body of the ferrule and then is capacitively coupled to and resonates with the inductance of the antenna radiating element. Accordingly, the ferrule must be electrically insulated from the antenna mounting structure.

Therefore it is an object of the present invention to provide for tuning a fiberglass rod antenna easily, accurately, and predictably.

It is another object of the present invention to provide a tuning mechanism for a fiberglass rod antenna that can be easily adjusted with readily available tools and is inexpensive.

It is yet another object of the present invention to provide for tuning a fiberglass rod antenna without cutting it to length or changing the value of a lumped inductance that is part of the antenna.

It is yet another object of the present invention to provide a mechanism for tuning a capacitance embodied in the mounting structure for a fiberglass rod antenna so that it resonates with the distributed inductance of the antenna.

It is yet another object of the present invention to provide a tuning mechanism that permits retuning the antenna numerous times without damage to the antenna.

It is yet another object of the present invention to provide a tuning mechanism for a fiberglass rod antenna that is integral with the mounting structure so that both tuning and securing the antenna are accomplished in the same operation by the same structure.

It is yet another object of the present invention to provide an improved antenna tuning mechanism that permits it to be mounted on a standard universal bracket assembly.

It is yet another object of the present invention to provide an improved monopole antenna element tuning mechanism utilizing a tuning capacitance formed between the radiating and supporting elements.

DESCRIPTION OF THE DRAWINGS

The novel features believed characteristic of the present invention are set forth in the appended claims. A complete description of the principles and embodiments of the invention as well as other objects, features, and advantages thereof will best be understood by reference to the following detailed description read in conjunction with the accompanying figures wherein:

DETAILED DESCRIPTION OF THE INVENTION

Figure 1:
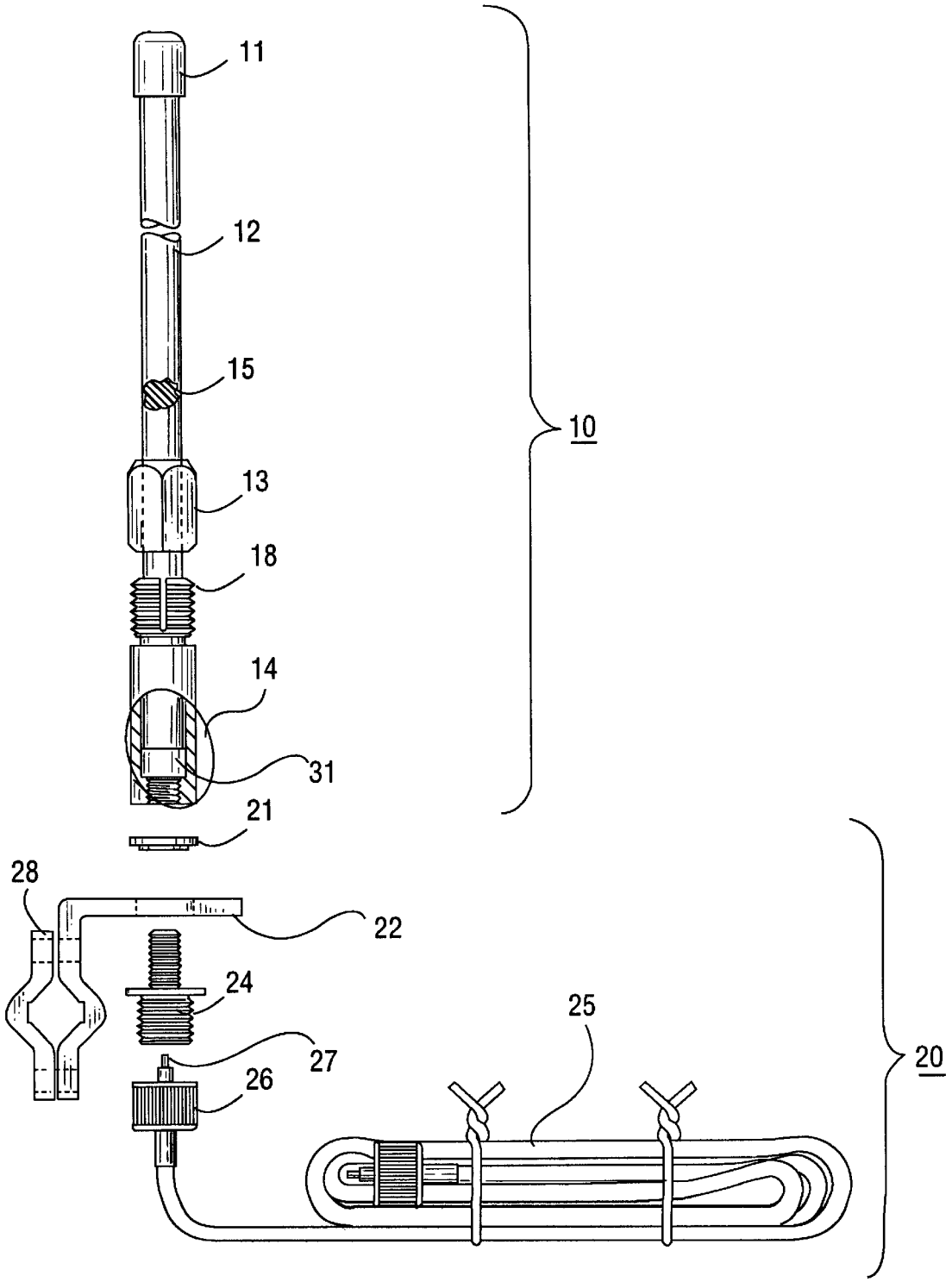
FIG. 1 is a simplified side view of the inventive antenna together with an illustrative bracket and connector assembly showing a typical use of the invention.

Referring to FIG. 1 an antenna assembly 10 embodying the present invention is shown in a typical application together with a standard mounting and coupling assembly 20 typically used for supporting a fiberglass monopole antenna. In the antenna assembly 10 a fiberglass whip 12, also known as a fiberglass rod antenna, is passed through an adjusting collar 13 and a metal compression ferrule 14 prior to a staking operation or the like which secures the nylon retaining sleeve 19 to the fiberglass whip 12. The fiberglass whip 12 with retaining sleeve 19 slides into the hollow bore of the compression ferrule 14 from the lower end of the compression ferrule 14 as shown in FIG. 1 but is prevented from passing through the upper end of the compression ferrule 14 by a stepped retainer (not shown in FIG. 1) formed within the hollow bore of the compression ferrule 14. In addition, the lower end of the compression ferrule 14 may include screw threads for receiving an adapter 24.

Adapter 24 serves two purposes. Its larger diameter threaded end connects to the shell of connector 26 thus connecting the shield conductors of coaxial cable 25 to the mounting bracket 22. The smaller diameter threaded end of adapter 24, which is insulated within adapter 24 from the larger diameter end, thus connects the signal pin 27 to the compression ferrule 14. Insulator 21 serves to insulate compression ferrule 14 from the mounting bracket 22 when the compression ferrule 14 is threaded upon the smaller threaded end of adapter 24. Bracket 22 facilitates attaching the mounting and coupling assembly to a mirror frame on a truck, for example, by means of clamp 28 and associated hardware (not shown).

Figure 2:
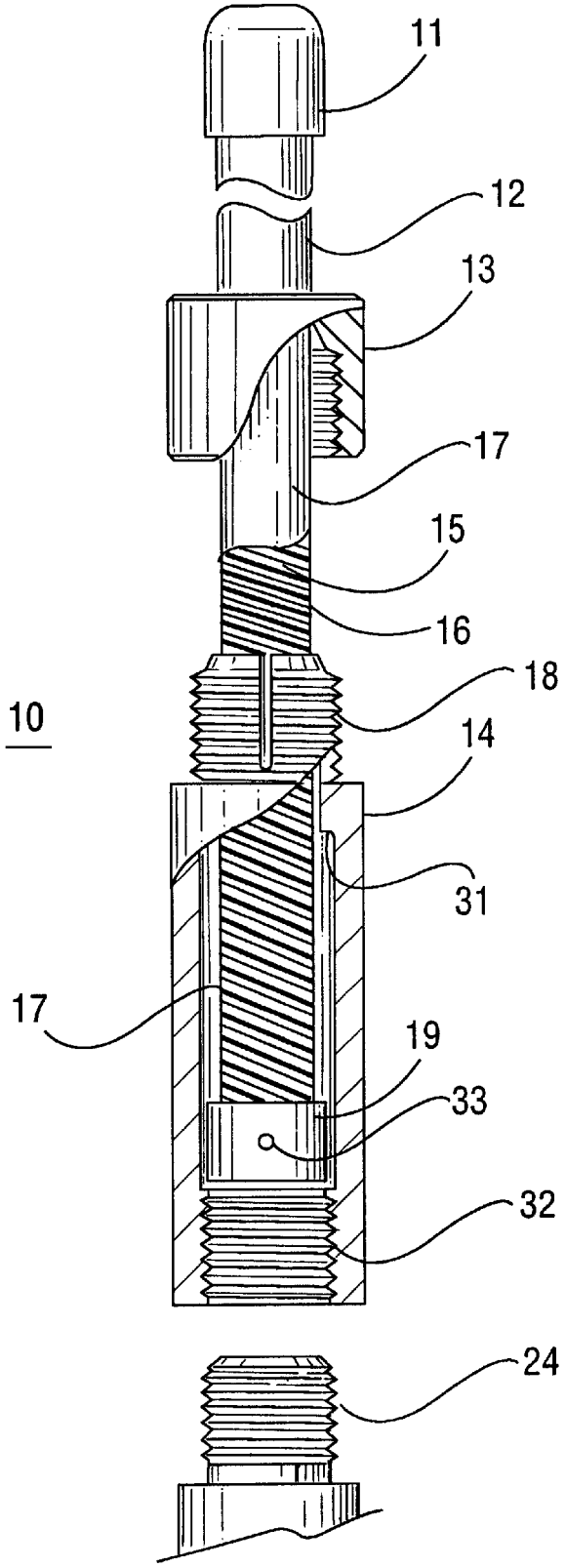
FIG. 2 is a detailed sectional view of the principle features of a preferred embodiment of the invention.

Details of the present invention as embodied within the antenna assembly 10 of FIG. 1 are described below with reference to the antenna assembly 10 shown in FIG. 2. The antenna assembly 10 of FIG. 2 is the same as the antenna assembly 10 of FIG. 1 except the presentation of FIG. 2 shows additional detail in the cut-a-way views of several key elements. Like elements are numbered alike in both FIG. 1 and FIG. 2 for ease of reference.

In FIG. 2 the fiberglass antenna 12 consists of a conductive wire antenna winding 15 wound in a helix around a fiberglass rod 16. The antenna winding 15 is secured to the fiberglass rod 16 at each end by means well known in the art and are therefore not described herein. As thus installed on the fiberglass rod 16, the antenna winding 15 provides the radiating element of the antenna. This radiating element, being a helical winding, is characterized by a fixed value of inductance corresponding to the number of turns and the diameter of the helix. In the present invention the helix is formed of 25 turns per inch on a rod of diameter 0.093 inches for the entire 48 inch length of the rod. A dielectric sleeve 17, disposed tightly around the antenna winding 15 in combination with the fiberglass rod 16 holds the antenna winding 15 in place along the fiberglass rod 16. The dielectric sleeve also forms the major part of the dielectric portion of a capacitance formed between the antenna winding 15 and the compression ferrule 14. The remaining portion of the dielectric is air because some clearance within the compression ferrule 14 must be allowed for the free movement of the antenna rod 16 within it.

As the insertion depth of the antenna winding 15 within the compression ferrule 14 is varied the electrical capacitance between them is also varied in direct proportion to the amount of overlap of the antenna winding 15 by the compression ferrule 14 in the longitudinal direction. This varying capacitance, which resonates with the inductance of the antenna winding 15, thus enables tuning the antenna to a desired frequency. In the preferred embodiment this capacitance varies between about 7.5 picofarad for the maximum extension of the antenna winding 15 from the compression ferrule 14 to about 13 picofarad for the minimum extension, i.e., maximum insertion, of the antenna winding 15 into the compression ferrule 14. The maximum extension of the antenna rod 15 from the compression ferrule 14 is limited by the need to retain a sufficient length of the antenna rod 15 within the compression ferrule 14 for mechanical stability. In the preferred embodiment the minimum required length is about 1.00 inch for an antenna 48 inches long.

The compression ferrule as shown in FIG. 2 has several characteristics which provide respectively for clamping the fiberglass antenna 12 in a secure position and limiting the amount of overlap and thereby the amount of capacitance that is tuned with the inductance of the fiberglass antenna 12. Compression ferrule 14 includes a slotted and threaded upper end forming a collet which can exert a clamping force around the fiberglass antenna when adjusting collar 13, is threaded upon the compression ferrule 14 and tightened. The adjusting collar 13, which has screw threads that match the threads of the compression ferrule 14, may be formed to facilitate tightening by using a wrench or other suitable tool. Alternatively the adjusting collar 13 may also have a knurled finish to facilitate tightening by hand without tools.

Further in reference to FIG. 2, the limit stop 31 is provided by a step-like change in the internal diameter of the compression ferrule 14. This limit stop 31 permits the fiberglass antenna 12 to pass freely through the smaller diameter but does not permit the retaining sleeve 19 to pass through the smaller diameter bore of the compression ferrule 14. The retaining sleeve 19, made of nylon in the preferred embodiment, may be attached to the fiberglass rod 16 by any suitable mechanical means for example, a staking pin 33, a recessed set screw, a permanent adhesive, or the like. The limit stop 31 thus determines the maximum extension of the fiberglass antenna 12 and the minimum value of the coupling capacitance. This limit corresponds to the highest resonant frequency to which the antenna can be tuned. The minimum extension of the fiberglass antenna 12, occurring at the maximum insertion of the fiberglass antenna 12 into the compression ferrule 14, is limited by the presence of the RF adapter 24 when it is fully threaded into the receptacle 32 of the compression ferrule. This minimum extension position of the fiberglass antenna 12 corresponds to the lowest resonant frequency to which the antenna can be tuned.

By way of explanation, the resonant frequency "F" of an inductance-capacitance ("L-C") circuit is determined by the well-known relationship:

$$F=\tfrac{1}{2}\pi(L\times C)^{1/2}$$

Thus, as the inductance L in the present invention is fixed, increasing the capacitance C acts to decrease the resonant frequency F. Conversely, decreasing the capacitance C acts to increase the resonant frequency F. In the preferred embodiment described above in conjunction with FIGS. 1 and 2, the highest value of the capacitance C is obtained at the maximum insertion of the fiberglass antenna 12 into the compression ferrule 14. Similarly the lowest value of the capacitance C is obtained at the maximum extension of the fiberglass antenna 12 from the compression ferrule 14. It is important to notice that in the present invention the lowest tunable frequency occurs at the shortest overall length of the antenna. This relationship is exactly opposite what might be expected from merely decreasing the length of the antenna because of the inverse relationship between frequency and the resonant capacitance.

Other materials suitable for use in the invention include nylon rod instead of fiberglass rod for the antenna rod to support the antenna radiator; fiberglass resin or heat shrink tubing made of polyolefin or polyvinyl chloride ("PVC") materials for the dielectric sleeve 17; nylon tubing for the retaining sleeve 19; chromium-plated or nickel-plated brass for the hollow clamping structure or compression ferrule 14, etc. Also in the preferred embodiment the dielectric constant of the preferred dielectric sleeve 17, a fiberglass resin, is approximately 5.0.

The following procedure for adjusting a tunable fiberglass antenna intended for use on the citizen's band is recommended:

1. Using an SWR meter or equivalent device, measure the SWR on the transceiver's lowest and highest channels.
2. Depending upon the readings obtained in Step 1:
   a) If the reading is higher on the lowest channel, loosen the adjusting collar and lower the whip 1/16 inch in the compression ferrule. While holding the whip in this position, retighten the adjusting collar.
   b) If the reading is higher on the highest channel, loosen the adjusting collar and raise the whip 1/16 inch in the compression ferrule. While holding the whip in this position, retighten the adjusting collar.
   c) Note: These adjustments move the antenna in the direction opposite to what one would expect if the antenna was a conventional metal rod. This tunable fiberglass antenna is lengthened to raise the tuning frequency and shortened to lower the tuning frequency.
3. Measure the SWR again and repeat the adjustment, if necessary, until the same SWR reading is obtained for both the lowest and highest channels. Be sure to adjust the antenna in small increments, checking the SWR each time.
4. To tune the antenna to one specific channel, adjust the antenna's position in the compression ferrule, in small increments until the lowest SWR reading is obtained when the transceiver is tuned to the desired channel. It is usually best to follow steps 1, 2, and 3 before attempting to optimize the antenna for a specific channel. This assures that the CB band is correctly covered by the tuning process and that the antenna position in the compression ferrule for the specific channel may be more readily located.

Figure 3A:
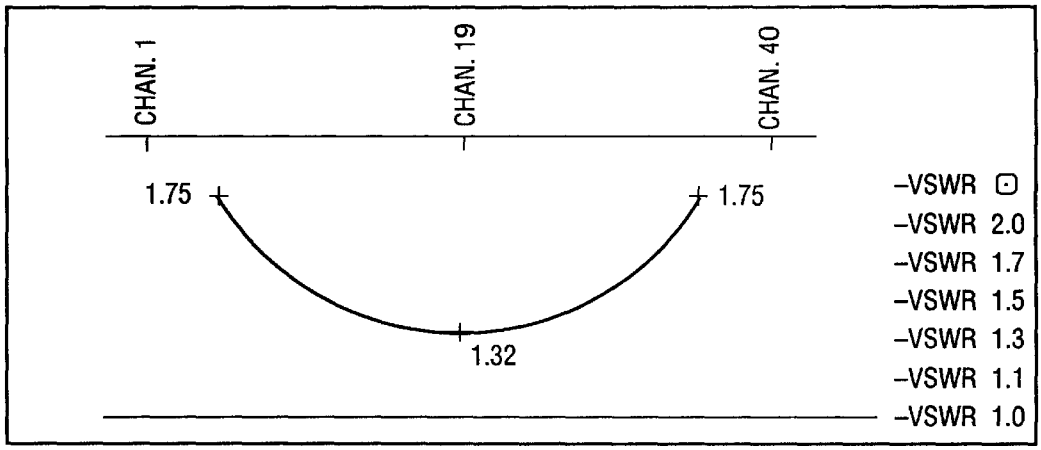
FIG. 3A is a graph of the VSWR characteristic of a fixed-tuned citizen's band antenna.
Figure 3B:
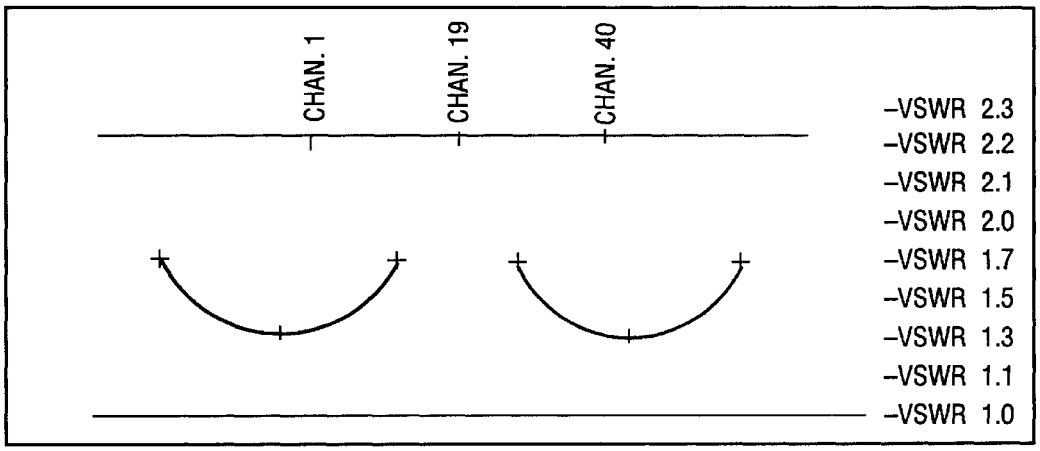
FIG. 3B is a graph of the tuning characteristics of the VSWR characteristic available with the present invention when tuned over the entire band of frequencies.

FIG. 3A presents test data plots of VSWR vs. frequency for a typical fiberglass CB antenna fixed-tuned to the center of the band at 27.185 MHZ (corresponding to citizen band Channel 19). FIG. 3B shows similar VSWR data plots for the antenna of the present invention tuned by varying the position of the antenna in the compression ferrule at the band edges at 26.965 and 27.405 MHZ (corresponding to citizen band Channels 1 and 40 respectively). A similar tuning characteristic can be expected for the present invention at any other channel of the band.

VSWR stands for voltage standing wave ratio. It is well known in the art that maximum power transfer occurs between the source and the load connected to RF transmission lines when the source and load impedances are matched 1-for-1 or 1.0 to 1. If the voltages across the actual load impedance such as an antenna, not exactly matched to the source impedance, is compared with the same voltage across a load which is exactly matched to the source impedance, the ratio of the unmatched-to-matched voltage measurements can be expressed as a number called the voltage standing wave ratio. This relationship holds when the load is driven at the intended frequency and is a measure of both the accuracy of the match under actual conditions at the center frequency and the variation of impedance from a matched condition as the signal frequency deviates from the tuned center frequency. Typically, a VSWR less than 2.0 to 1 is satisfactory while a VSWR less than about 1.5 to 1 is excellent and represents an efficient match of the load impedance to the signal source impedance driving the load impedance.

FIG.3A shows a satisfactory match over most of the CB band with a fixed tuned antenna. Notice, however, that because of the relatively high VSWR at the band edges, the reception of Channels 1 and 40 will be significantly poorer than the reception at the center frequency, Channel 19. The effect is a substantial reduction in the range of the transmitted signal. It can thus be seen that the ability to tune the antenna to a desired channel results in the maximum available transmission or reception range at the tuned frequency of the individual antenna installations.

FIG. 3B shows the VSWR data plots for the tunable antenna of the present invention at the CB band endpoint Channels 1 and 40 corresponding to the antenna whip being fully inserted and fully extended from the compression ferrule. It can be seen that the antenna may be readily tuned or optimized to any channel within the antenna's band width, that for all channels the VSWR varies uniformly above and below the tuned frequency within a satisfactory range, and in addition provides an excellent match at the tuned frequency.

Figure 4A:
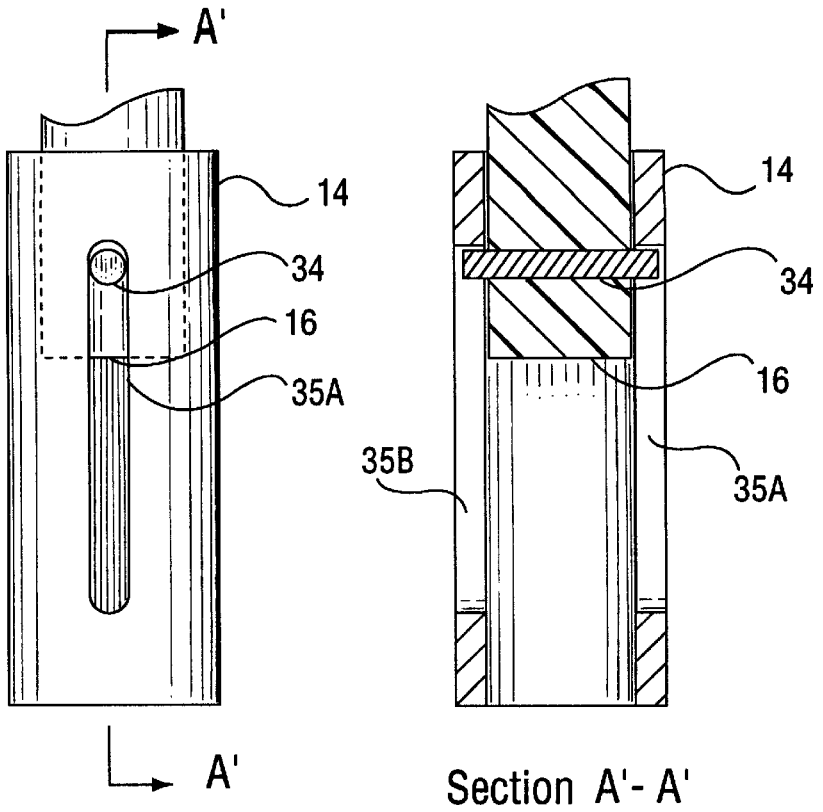
FIG. 4A shows an alternate embodiment for limiting the linear travel at maximum extension of the antenna rod from the hollow clamping structure.
Figure 4B:
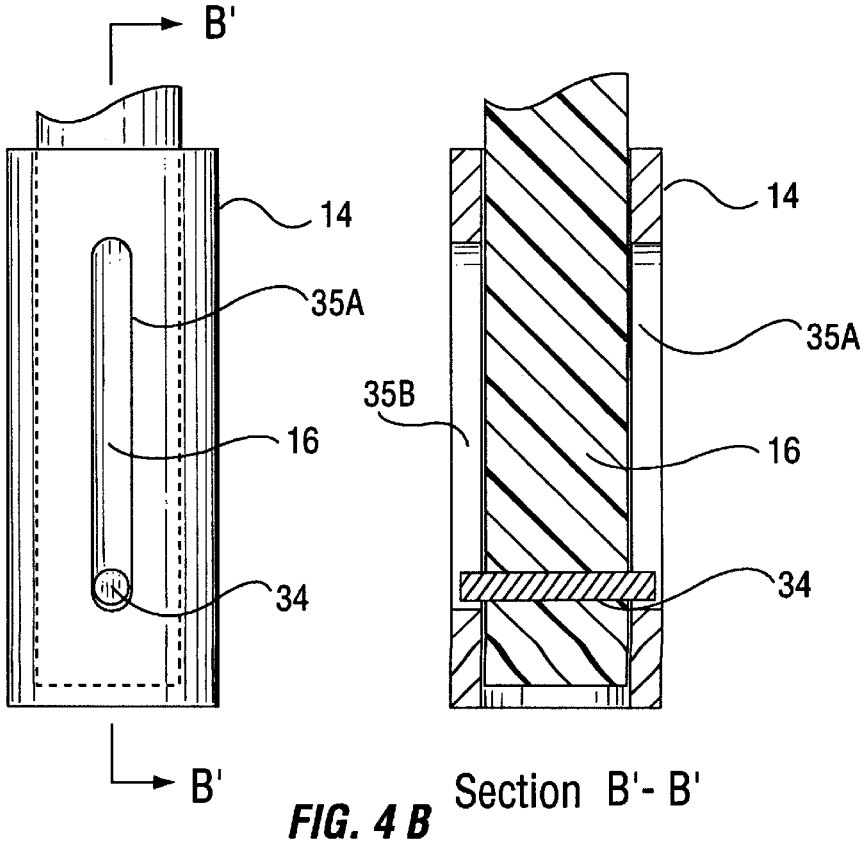
FIG. 4B shows an alternate embodiment for limiting the linear travel at minimum extension of the antenna rod from the hollow clamping structure.

Several modifications to the structures and methods employed in the present invention are possible resulting in alternative embodiments to expand the utility thereof. By way of illustration, as shown in FIG. 4, the linear travel of the antenna rod 16 within the compression ferrule 14 may be limited by means of a pin 34 fitted through the long axis of the antenna rod and at right angles to it. The ends of the pin 34 slidably engage a corresponding pair of longitudinal slots 35A and 35B formed in the compression ferrule 14 adjacent to each side of the antenna rod 16. The length of the pin 34 is approximately equal to the diameter of the compression ferrule 14 so that the travel of the antenna rod 16 is limited as the ends of the pin 34 reaches the end of the respective longitudinal slots 35A and 35B at both the maximum (see FIG. 4A) and minimum (see FIG. 4B) extensions of the antenna rod 16 relative to the compression ferrule 14. Limiting the linear travel of the antenna rod 16 is not absolutely essential to the functioning of the invention; however the utility of the tuning mechanism of the present invention is markedly improved by including some limiting means as illustratively described above.

Similarly the adjusting collar for the compression ferrule used to clamp the antenna rod within the ferrule at the desired adjustment may be formed with a standard hexagonal (see FIG. 1) or other configuration for tightening by means of an adjustable wrench, or other suitable tool. In some applications the adjusting collar for the compression ferrule may suitably have a knurled surface to facilitate tightening by hand. Further alternatives including other forms of a mechanical chuck may be constructed to perform the tightening or clamping function. Yet another alternative to secure the antenna rod into the desired tuning position within the compression ferrule is an array of set screws, preferably of non-conductive material, each aligned with a radius along a common diameter of the antenna rod and compression ferrule and spaced at uniform intervals.

Variations in the spacing between the antenna radiator and the inner surface of the metallic hollow clamp or compression ferrule, the dielectric material interposed therein, and the length of the linear travel of the antenna radiator relative to the metallic hollow clamp or compression ferrule may be employed alone or in combination to achieve the range of capacitance variations needed to tune with the particular antenna parameters. For example, while the length of the antenna rod's travel within the hollow clamping structure or compression ferrule in the preferred embodiment is in the range of 1.0" to 1.5" for a 48" CB antenna, other lengths are possible for other applications depending on the operating frequency of the antenna, the required capacitance variation, sensitivity of tuning to the adjustment of antenna depth in the hollow clamping structure, mechanical and cost considerations regarding the hollow clamping structure, and the like.

For another example, it is contemplated that capacitive coupling using the present invention with a metal rod antenna having a lumped inductive element incorporated into its length to enable tuning to resonance may be utilized by placing suitable insulation or dielectric between the antenna rod and the supporting ferrule. Such a construction would provide similarly repeatable and predictable results to tuning operations described above for the preferred embodiment employing a fiberglass or nylon rod antenna. Non-conductive set screws may be used to secure a metal antenna rod within the ferrule with little risk of damage to the antenna rod element itself particularly if the dielectric sleeve, for example, is a thin layer of dielectric material installed into and retained against the inner bore of the ferrule. The non-conductive set screws maintain the electrical isolation between the antenna rod and the hollow clamping structure or ferrule. Furthermore, a rigid dielectric sleeve may also function as an alternative dielectric for the coupling capacitance that is useable in any of the embodiments described herein. Other variations contemplated for the present invention include thin layers of conductive material as substitutes for the plates of the capacitor disposed upon the antenna rod or within the internal internal of the hollow clamping means. In each case the conductive material representing a plate of a tuning capacitor is electrically connected to the antenna radiator and the RF signal cable respectively. Moreover, for certain antenna designs the tunable capacitive coupling of the present invention may be arranged at positions along the antenna other than at an end of the antenna rod.

The preferred embodiment and several illustrative alternative embodiments have been shown and described. It will readily be apparent to those skilled in this art that various other modifications may be made in these embodiments without departing from the spirit of and which lie within the scope of the invention set forth in the following claims:

I claim:

1. A tunable antenna comprising:

an antenna element having distal and proximate ends comprising a radiating element having a fixed inductance;

a dielectric sleeve encasing said proximate end of said antenna element; and a mount for receiving said encased proximate end of said antenna element wherein said mount is capacitively coupled to said encased proximate end of said antenna element to achieve a specific capacitance value.

2. The tunable antenna as recited in claim 1 wherein said radiating element is disposed about a dielectric core.

3. The tunable antenna as recited in claim 1 wherein said capacitance value is adjustable.

4. The tunable antenna as recited in claim 3 wherein said capacitance value adjustment is performed by moving said proximate end of said antenna element within said mount.

5. The tunable antenna as recited in claim 4 wherein said capacitance value corresponding to a maximum insertion of said encased proximate end of said antenna element into said mount is at least about 1.5 times a capacitance value corresponding to a minimum insertion therein.

6. The tunable antenna as recited in claim 1 wherein said dielectric sleeve has a dielectric constant of at least about 3.0.

7. The tunable antenna as recited in claim 1 wherein said antenna element comprises a monopole antenna.

8. A tunable antenna comprising:

an antenna rod having a fixed inductance and first and second ends, said antenna rod encased in a dielectric sleeve;

a conductive sleeve for adjustably receiving said first end of said encased antenna rod to a variable depth; and said conductive sleeve and said encased antenna rod having a capacitance wherein varying said variable depth varies said capacitance.

9. The tunable antenna of claim 8 wherein said conductive sleeve further comprises a clamp for securing said encased antenna rod.

10. The tunable antenna of claim 9 wherein said clamp comprises a compression ferrule for compressively securing said encased antenna rod.

11. The tunable antenna of claim 8 wherein said antenna rod further comprises a helically-wound conductor.

12. The tunable antenna of claim 8 wherein said antenna rod comprises a metal rod.

13. A tunable antenna comprising:

means for radiating having a fixed inductance;

means for encasing said means for radiating; and means for capacitively receiving said encased means for radiating to achieve a specific capacitance.

14. The tunable antenna of claim 13 further comprising a means for adjusting said specific capacitance.

15. The tunable antenna of claim 13 wherein said means for encasing said means for radiating is a dielectric.

16. The tunable antenna of claim 13 wherein said means for receiving said proximate end of said encased means for radiating comprises a compression ferrule.

17. A method for tuning an antenna comprising:

encasing a radiating element having a fixed inductance in a dielectric; and capacitively coupling said radiating element to a conductive sleeve to achieve a specific capacitance value.

18. The method of claim 17 further comprising varying the depth of said radiating element in the conductive sleeve to vary the capacitance value.

19. The method of claim 17 wherein said capacitively coupling comprises clamping said radiating element within said conductive sleeve.

* * * * *